US005560076A

United States Patent [19]

Leung

[11] Patent Number: 5,560,076

[45] Date of Patent: Oct. 1, 1996

[54] COMBINED VACUUM CLEANER AND TORCH

[75] Inventor: Sing K. Leung, Pacific Palisades, Hong Kong, Hong Kong

[73] Assignee: Hoovine Industrial Limited, Hong Kong

[21] Appl. No.: 338,029

[22] Filed: Nov. 14, 1994

[51] Int. Cl.[6] ..... A47L 5/24; A47L 9/30

[52] U.S. Cl. ..... 15/339; 15/323; 15/324; 15/344; 15/DIG. 1

[58] Field of Search ..... 15/339, 344, DIG. 1, 15/323, 324

[56] References Cited

U.S. PATENT DOCUMENTS

| | | | |
|---|---|---|---|
| 4,656,687 | 4/1987 | Wei | 15/344 X |
| 4,704,765 | 11/1987 | Ataka | 15/344 X |
| 4,829,625 | 5/1989 | Wang | 15/344 X |
| 4,934,020 | 6/1990 | Jackson | 15/344 X |

FOREIGN PATENT DOCUMENTS

| | | | |
|---|---|---|---|
| 2141329 | 12/1984 | Japan . | |
| 805909 | 12/1958 | United Kingdom | 15/344 |
| 910383 | 11/1962 | United Kingdom | 15/344 |

*Primary Examiner*—Chris K. Moore
*Attorney, Agent, or Firm*—Stephen M. Evans; David L. Garrison

[57] ABSTRACT

A portable vacuum cleaner with removable flashlight is disclosed. The invention is broadly characterized as a vacuum cleaner housing having a front portion and a rear portion with vacuum cleaner components such as an impeller, motor, and filter disposed therein; a stand-alone flashlight housing of conventional design having a contained power source disposed therein; and a connector electrically coupling the contained power source of the flashlight to the vacuum cleaner components so that the vacuum cleaner is operable by utilizing power from the flashlight power source. In an alternative embodiment, the vacuum cleaner has its own dedicated contained power source so that the vacuum cleaner may be operated independently of the flashlight. In preferred form, the flashlight is disposed in the cleaner housing and removably engaged therewith by way of a latch. External contacts on the flashlight beneficially connect with cleaner housing contacts to deliver power to the vacuum cleaner components. All contained power sources are preferably batteries rechargeable by application of an external power source either directly through an interface in the cleaner housing, or through a support assembly having electrical contacts which electrically couple the support to corresponding cleaner housing contacts.

15 Claims, 3 Drawing Sheets

COMBINED VACUUM CLEANER AND TORCH

DISCLOSURE OF THE INVENTION

The present invention relates to a vacuum clearer assembly which is a combination of a vacuum cleaner and a torch.

According to the invention, there is provided a vacuum cleaner assembly which comprises a vacuum cleaner and a torch, which vacuum cleaner comprises an elongate body having at its front end a nozzle and at its rear end a handle and an opening, said torch being arranged to be inserted backward into the body through the opening and thereby engaged substantially within the vacuum cleaner body.

Preferably, the vacuum cleaner and the torch are both provided with rechargeable batteries and separate pairs of battery contacts which are arranged to be close together or in electrical contact with each other to enable simultaneous recharging of the batteries when the torch is engaged substantially within the vacuum cleaner body.

More preferably, at least one of the battery contacts of the torch is provided inside a body of the torch, which battery contact is contactable through a hole in the torch body by an associated battery contact of the vacuum cleaner when the torch is engaged substantially within the vacuum cleaner body.

The vacuum cleaner assembly may further include a support for releasably supporting the vacuum cleaner on a wall, which support is provided with a pair of electrical contacts for electrical connection at one end to an external power supply and at the other end to the battery contacts of the vacuum cleaner when the vacuum cleaner is supported by the support.

In a preferred embodiment, the torch is arranged to be engaged within the vacuum cleaner body at substantially the same position as the handle with respect to the longitudinal extent of the vacuum cleaner body.

More specifically, the handle has upper and lower limbs, said upper limb being for hand-gripping, and the torch is arranged to extend within the lower handle limb when the torch is engaged substantially within the vacuum cleaner body.

It is preferred that the torch has an enlarged head which is adapted to close the opening when the torch is engaged substantially within the vacuum cleaner body.

Advantageously, the head of the torch and the opening of the vacuum cleaner body are provided with inter-engageable snap-fitting means for holding the torch substantially within the vacuum cleaner body.

BRIEF DESCRIPTION OF THE DRAWINGS

The invention will now be more particularly described, by way of example only, with reference to the accompanying drawings, in which.

BEST MODE FOR CARRYING OUT THE INVENTION

Figure 1:
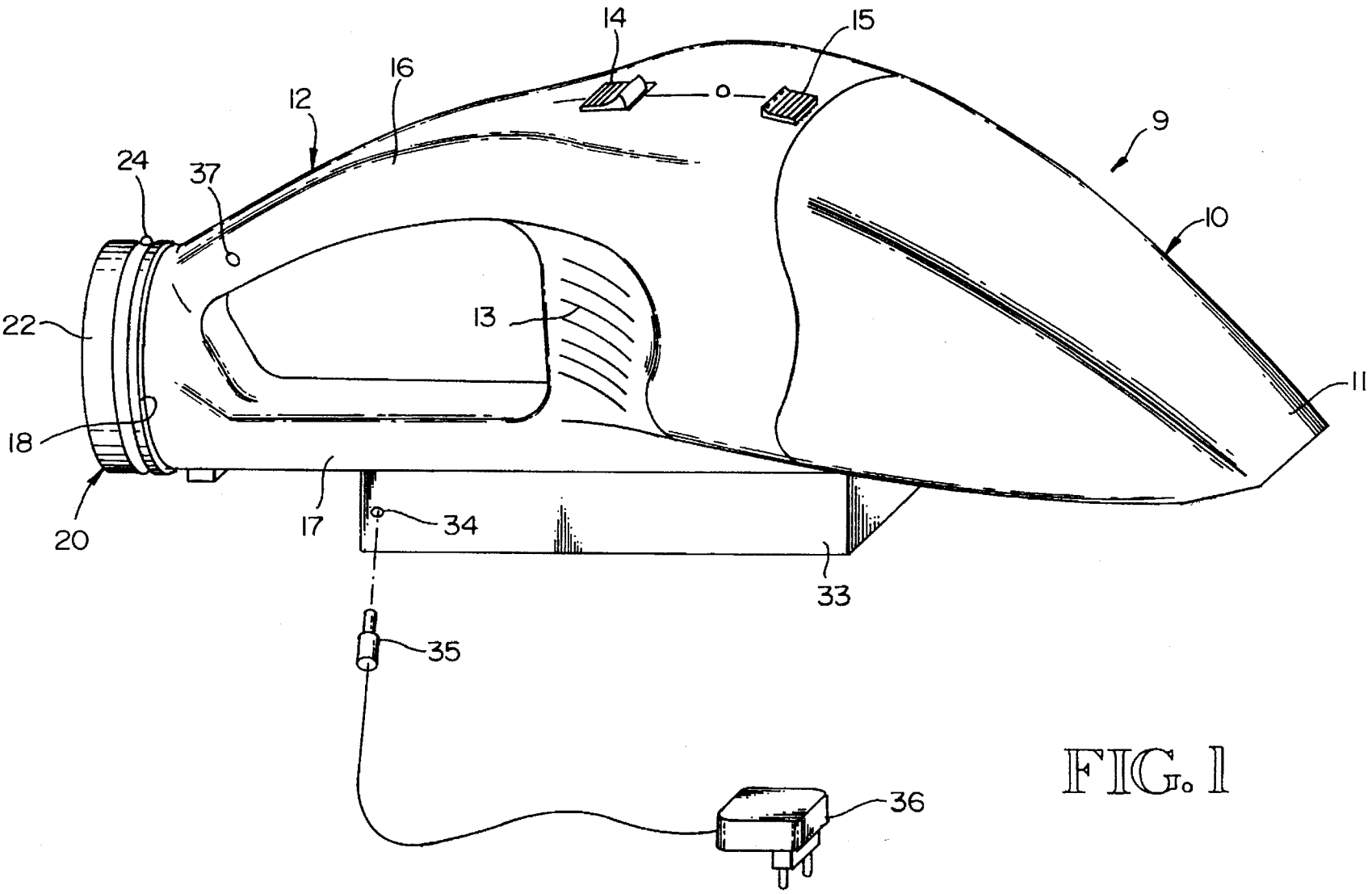
FIG. 1 is a side perspective view of an embodiment of a vacuum cleaner assembly in accordance with the invention, comprising a vacuum cleaner and a torch.
Figure 3:
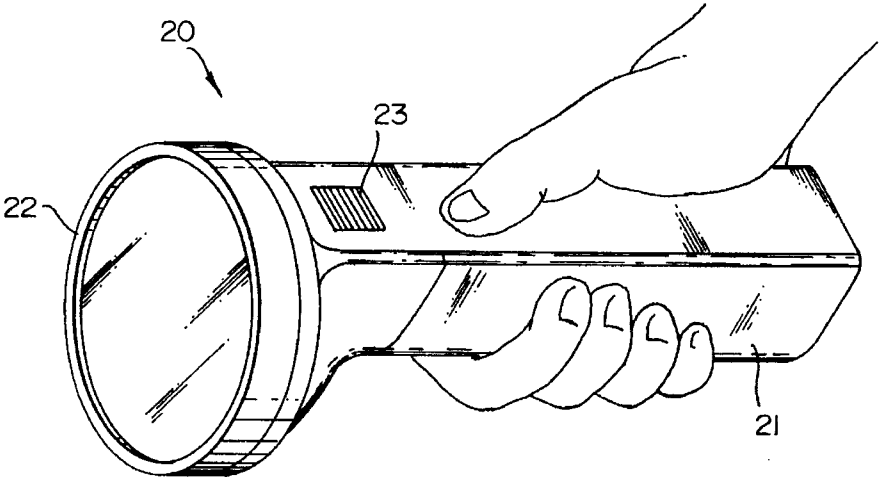
FIG. 3 is a front-end and a side perspective view of the torch of FIG. 2.
Figure 2:
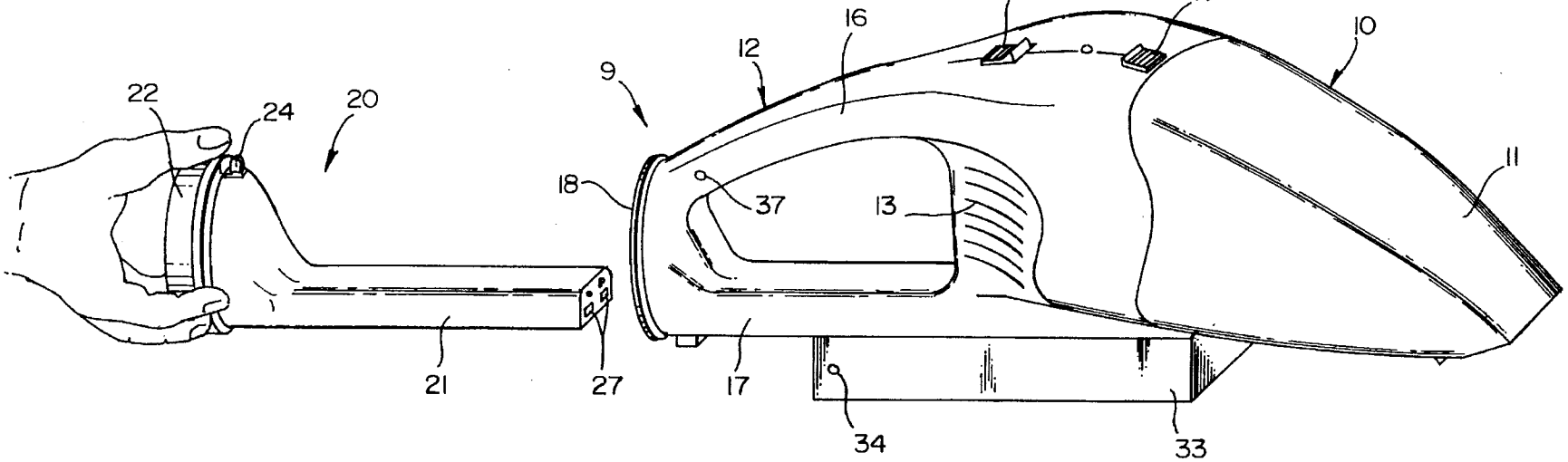
FIG. 2 is a side perspective view of the vacuum cleaner assembly of FIG. 1, with the vacuum cleaner and the torch thereof separated.

Referring firstly to FIGS. 1 to 3 of the drawings, there is shown a vacuum cleaner assembly embodying the invention, which assembly is formed by a vacuum cleaner 9 and a torch 20, both being operated by rechargeable batteries. The vacuum cleaner 9 has an elongate body 10 which has at its front end an intake nozzle 11, at its rear end a handle 12 and_an intermediate position a series of exhaust slots 13.

As in known vacuum cleaners, the body 10 houses a vacuum cleaning mechanism (not shown) which is provided by a motor-driven suction fan provided in an air passage extending from the intake nozzle 12 to the exhaust slots 13. The vacuum cleaning mechanism further includes a filter bag which is used in the air passage behind the intake nozzle 12. A toggle switch 14 is provided on the body 10 for switching on the suction fan in order to generate an air flow into the body 10 through the intake nozzle 11. The air flow passes through the filter bag and subsequently exits through the exhaust slots 13, whereby dust particles carried by the air flow are caught and thus collected in the filter bag. The intake nozzle 11 is removable, by releasing a latch 15 on the body 10, so as to permit replacement of the filter bag. Having so far been described, the vacuum cleaner 9 operates in the same manner as the conventional vacuum cleaners.

The handle 12 has upper and lower limbs 16 and 17 which are joined at their rear ends to form a circular opening 18. The handle lower limb 17 is hollow and defines therein an elongate compartment 19 (FIG. 4) having the body rear opening 18 as its opening which is significantly larger than the general cross-section of the compartment 19.

The torch 20 has an elongate body 21 and an enlarged circular head 22. A slide switch 23 is provided on the top wall of the torch body 21, immediately behind the torch head 22, and a latch 24 is provided on the bottom side of the torch head 22.

Figure 4:
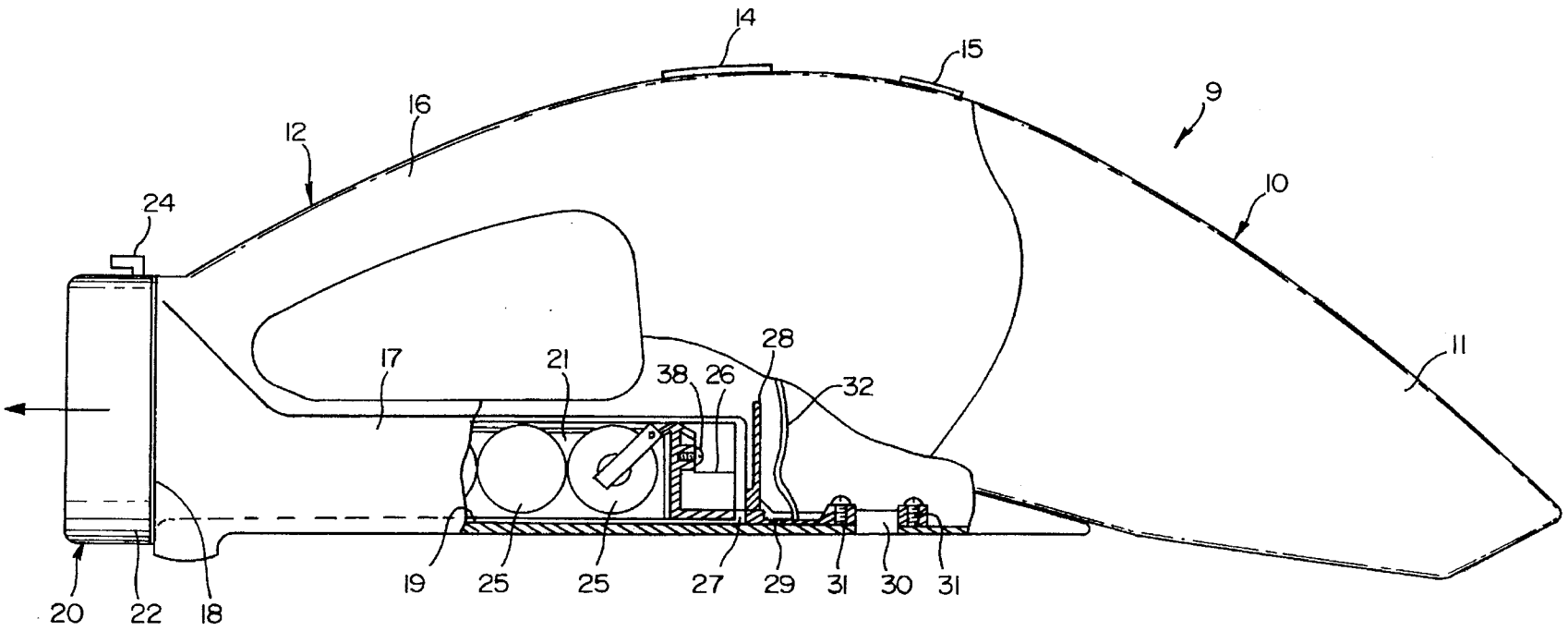
FIG. 4 is a side view of the vacuum cleaner assembly of FIG. 1, partly broken to illustrate the electrical connection between the vacuum cleaner and the torch.

Reference is now made to FIG. 4 of the drawings. The torch 20 has an overall shape corresponding to and a size slightly smaller than that of the compartment 19, and is adapted to be removably accommodated (substantially) in the compartment 19. When the torch 20 is engaged substantially within the vacuum cleaner body 10, its head 22 covers and thus closes the rear body opening 18. The torch 20 is held inside the vacuum cleaner body 10 by means of the latch 24 engaging the rim of the opening 18.

The torch 20 includes a row of rechargeable battery cells 25 in the torch body 21. The battery cells 25 are connected electrically in series and then to a light bulb (not shown) in the torch head 22 via the slide switch 23, thereby forming a complete lighting circuit. The battery cells 25 are also connected to a pair of opposed recharging contacts 26 which are located by corresponding screws 38 inside the rear end of the torch body 21. The recharging contacts 26 are bent as shown and resiliently urging against the inner side of the top (bottom as shown) walls of the torch body 21, forming in effect an electrical socket. The rear end wall of the torch body 21 has a pair of holes 27 through which the corresponding recharging contacts 26 are accessible.

The innermost end of the compartment 19 of the vacuum cleaner body 10 is defined by a vertical partition 28. A pair of electrically conducting strips 29 passes rearward through the partition 28 into the compartment 19, forming in effect an electrical plug which is aligned with the holes 27 of the torch body 21. The arrangement is such that when the torch 20 is inserted backward into the compartment 19 through the rear body opening 18, the stationary strips 29 will enter into the torch body 21 through the corresponding holes 27 and come into electrical connection with the respective recharging contacts 26 of the torch 20. This electrical connection is maintained by the recharging contacts 26 now urging resiliently against the corresponding strips 29.

On the opposite side of the partition 28, each strip 29 extends forward and on its way indents into a respective hole 30 formed in the bottom wall of the vacuum cleaner body 10. The part of the strip 29 inside the respective hole 30 lies flush with the outer side of the hole 30. Each strip 29 is fixed in position by two screws 31 on opposite sides of the respective hole 30.

The vacuum cleaner body 10 houses a number of rechargeable battery cells (not shown) which are connected to the internal vacuum cleaning mechanism via the toggle switch 14 to form a complete operation circuit. The battery cells are also connected to the strips 29 by respective wires 32 for battery recharging.

The vacuum cleaner assembly further includes a bracket 33 for supporting the whole assembly on a wall. Although this is not shown in the drawings, the bracket 33 is provided with a pair of electrical terminals for contact with the corresponding strips 29 of the vacuum cleaner 9 at the holes 30. The bracket 33 has a socket 34 which is wired to the electrical terminals for connection with a plug 35 of an external battery charger 36. When the vacuum cleaner 9 is supported on the bracket 33, its built-in battery cells can be recharged by the battery charger 36. The vacuum cleaner 9 also has a socket 37 on the handle upper limb 16 for its built-in battery cells to be recharged directly by the battery charger 36 when the vacuum cleaner 9 is off the bracket 33.

The whole vacuum cleaner assembly is normally supported on the bracket 33. In this condition, both the vacuum cleaner 9 and the torch 20 can be recharged simultaneously because their built-in battery cells are electrically connected together by means of their respective strips 29 and the contacts 26. The torch 20 may be removed from the vacuum cleaner 9 for use, with the vacuum cleaner 9 remaining to be recharged. The vacuum cleaner 9 itself may be used at any time, irrespective of whether the torch 20 is present.

For the purposes of simultaneous recharging, it is appreciated that the battery contacts of the vacuum cleaner and the torch need not necessarily to be in direct physical contact with each other, in that they may be arranged to be separate but close together such that both of them will simultaneously come into contact with a plug of an external battery charger when the plug is inserted which is thus used as a bridge.

The storage of the torch 20 inside the rear end of the vacuum cleaner body 10 has the advantage of shifting the centre of gravity of the overall assembly rearward, thereby rendering the whole assembly easier to handle. In this regard, it is envisaged that the torch may not necessarily be accommodated within the handle proper, but adjacent thereto or in substantially the same position as the handle with respect to the longitudinal extent of the vacuum cleaner body.

The invention has been given by way of example only, and various other modifications of and/or alternations to the described embodiment may be made by persons skilled in the art without departing from the scope of the invention as specified in the appended claims.

What is claimed is:

1. A vacuum cleaner assembly comprising:

a cleaner housing having a front portion and a rear portion, the cleaner housing having the capacity to accept vacuum cleaner components including a motor, an impeller, and a filter, and having the capacity to accept a flashlight;

a flashlight having a housing, and a light producing element and a contained power source operatively coupled together and generally disposed in the housing, wherein the flashlight is releasably engagable with the cleaner housing and separately operable therefrom; and connector means for coupling the contained power source with vacuum cleaner components to permit passage of current from the contained power source to the vacuum cleaner components.

2. The assembly of claim 1 wherein the rear portion of the cleaner housing defines a void and an opening wherein the flashlight housing is formed to releasably engage with the void and opening.

3. The assembly of claim 2 wherein the flashlight housing has an elongated portion that surrounds the contained power source and a lens portion that surrounds the light producing element, and wherein the void of the cleaner housing is sized to receive the elongated portion of the flashlight housing, and the cleaner housing defining the opening of the rear portion is formed to releasably engage with the lens portion of the flashlight housing.

4. The assembly of claim 1 further comprising a second contained power source disposed in the cleaner housing to permit operation of the vacuum assembly when the flashlight is removed therefrom.

5. The assembly of claim 4 wherein the first contained power source comprises at least one exposed electrical contact, wherein the second contained power source comprises at least one electrical contact, and wherein the at least one contact of the first contained power source and the at least one contact of the second contained power source are contactable with each other to permit electrical coupling therebetween.

6. The assembly of claim 5 further comprising a docking support that is releasably engagable with the cleaner housing, is mountable to a surface, and has at least one exposed electrical contact, wherein the cleaner housing further comprises at least one corresponding electrical contact, operatively coupled to the second contained power source, whereby when the cleaner housing is engaged with the docking support, the contact of the support electrically couples with the contact of the cleaner housing.

7. The assembly of claim 6 further comprising an external power source electrically coupled to the at least one electrical contact of the docking support.

8. The assembly of claim 1 further comprising a docking support that is releasably engagable with the cleaner housing, is mountable to a surface, and has at least one exposed electrical contact, wherein the cleaner housing further comprises at least one corresponding electrical contact, operatively coupled to the first contained power source, whereby when the cleaner housing is engaged with the docking support, the contact of the support electrically couples with the contact of the cleaner housing.

9. The assembly of claim 8 further comprising an external power source electrically coupled to the at least one electrical contact of the docking support.

10. The assembly of claim 1 wherein the cleaner housing has, at the rear portion thereof, a handle portion.

11. The assembly of claim 7 wherein the flashlight housing further comprises a securing means for selectively engaging and disengaging the flashlight from the cleaner housing in response to user operation thereof.

12. A vacuum cleaner assembly comprising:

a cleaner housing having a front portion and a rear portion, the front portion of the housing having the capacity to accept vacuum cleaner components including a motor, an impeller, and a filter, and the rear portion of the housing defining a void and opening;

a flashlight having a housing with securing means, and a light producing element and a contained power source operatively coupled together and generally disposed in the housing, wherein the flashlight is releasably engagable with the cleaner housing using the securing means and separately operable therefrom; and connector means for coupling the contained power source of the flashlight with vacuum cleaner components to permit passage of current from the contained power source to the vacuum cleaner components.

13. The assembly of claim 12 wherein the securing means is located proximate to the light producing element.

14. The assembly of claim 12 further comprising a docking support that is releasably engagable with the cleaner housing, is mountable to a surface, and has an interface to an external power source coupled to at least one exposed electrical contact, wherein the cleaner housing further comprises at least one corresponding electrical contact, operatively coupled to the contained power source, whereby when the cleaner housing is engaged with the docking support, the contact of the support electrically couples with the contact of the cleaner housing.

15. The assembly of claim 12 further comprising an interface to an external power source.

* * * * *

UNITED STATES PATENT AND TRADEMARK OFFICE

CERTIFICATE OF CORRECTION

PATENT NO. : 5,560,076

DATED : October 1, 1996

INVENTOR(S) : Sing K. Leung

It is certified that error appears in the above-indentified patent and that said Letters Patent is hereby corrected as shown below:

On the title page, item [54], and Column 1, line 2,

In the title, delete "TORCH", and insert --FLASHLIGHT--.

Column 1, line 7, delete "clearer" and insert --cleaner--.

Column 1, line 8, delete "torch" and insert --flashlight--.

Column 1, line 10, delete "which comprises" and insert --comprising--.

Column 1, line 11, delete "torch, which" and insert --flashlight, the--.

Column 1, line 13, delete "said torch being arranged to" and insert --in which the flashlight can--.

Column 1, line 14, delete "backward".

Column 1, line 14, delete "through the opening".

Column 1, line 16, delete "torch" and insert --flashlight--.

Column 1, line 17, delete "separate" and insert --corresponding--.

Column 1, line 18, delete "to be close together" and insert --adjacent to one another,--

UNITED STATES PATENT AND TRADEMARK OFFICE

CERTIFICATE OF CORRECTION

PATENT NO. : 5,560,076
DATED : October 1, 1996
INVENTOR(S) : Sing K. Leung

It is certified that error appears in the above-identified patent and that said Letters Patent is hereby corrected as shown below:

Column 1, line 19, insert the word --are-- before "in electrical".

Column 1, line 19, after the word "other" insert a comma

Column 1, line 19, insert the word --thereby-- before the word "enable".

Column 1, line 20, delete "torch" and insert --flashlight--.

Column 1, line 23, delete "torch" and insert --flashlight-- in both instances.

Column 1, line 24, delete "torch" and insert --flashlight--.

Column 1, line 25, delete "torch" and insert --flashlight--.

Column 1, line 27, delete "torch" and insert --flashlight--.

Column 1, line 31, delete "which support is provided with" and insert --the support preferably including--.

Column 1, line 34, delete "supported" and insert --engaged--.

Column 1, line 35, delete "by" and insert --with--.

Column 1, line 36, delete "torch" and insert --flashlight--.

Column 1, line 40, connect this paragraph to preceding paragraph.

Column 1, line 41, delete "torch" and insert --flashlight--.

UNITED STATES PATENT AND TRADEMARK OFFICE

CERTIFICATE OF CORRECTION

PATENT NO. : 5,560,076
DATED : October 1, 1996
INVENTOR(S) : Sing K. Leung

It is certified that error appears in the above-identified patent and that said Letters Patent is hereby corrected as shown below:

Column 1, line 43, delete "torch" and insert --flashlight--.

Column 1, line 45, delete "torch" and insert --flashlight--.

Column 1, line 46, delete "torch" and insert --flashlight--.

Column 1, line 48, connect this paragraph with preceding paragraph.

Column 1, line 48, delete "torch" and insert --flashlight--.

Column 1, line 50, delete "torch" and insert --flashlight--.

Column 1, line 62, delete "torch" and insert --flashlight--.

Column 1, line 64, delete "torch" and insert --flashlight--.

Column 1, line 67, delete "torch" and insert --flashlight--.

Column 2, line 10, delete "torch" and insert --flashlight--.

Column 2, line 11, after the word batteries insert --(shown in Figure 4)--.

Column 2, line 14, after the word an insert --at--.

Column 2, line 33, delete "handle".

UNITED STATES PATENT AND TRADEMARK OFFICE

CERTIFICATE OF CORRECTION

PATENT NO. : 5,560,076
DATED : October 1, 1996
INVENTOR(S) : Sing K. Leung

It is certified that error appears in the above-identified patent and that said Letters Patent is hereby corrected as shown below:

Column 2, line 37, delete "torch" and insert --flashlight--.

Column 2, line 39, delete "torch" and insert --flashlight-- in both instances.

Column 2, line 40, delete "torch" and insert --flashlight--.

Column 2, line 43, delete "torch" and insert --flashlight--.

Column 2, line 46, delete "torch" and insert --flashlight--.

Column 2, line 48, delete "torch" and insert --flashlight--.

Column 2, line 51, delete "torch" and insert --flashlight--.

Column 2, line 52, delete "torch" and insert --flashlight--.

Column 2, line 54, delete "torch" and insert --flashlight--.

Column 2, line 58, delete "torch" and insert --flashlight--.

Column 2, line 61, delete "torch" and insert --flashlight--.

Column 2, line 67, delete "torch" and insert --flashlight--.

Column 3, line 3, delete "torch" and insert --flashlight-- in both instances.

Column 3, line 6, delete "torch" and insert --flashlight--.

Column 3, line 8, delete "torch" and insert --flashlight--.

UNITED STATES PATENT AND TRADEMARK OFFICE

CERTIFICATE OF CORRECTION

PATENT NO. : 5,560,076
DATED : October 1, 1996
INVENTOR(S) : Sing K. Leung

It is certified that error appears in the above-identified patent and that said Letters Patent is hereby corrected as shown below:

Column 3, line 40, delete "torch" and insert --flashlight--.

Column 3, line 43, delete "torch" and insert --flashlight--.

Column 3, line 46, delete "torch" and insert --flashlight--.

Column 3, line 49, delete "torch" and insert --flashlight--.

Column 3, line 54, delete "torch" and insert --flashlight--.

Column 3, line 56, delete "centre" and insert --center--.

Column 3, line 58, delete "torch" and insert --flashlight--.

Signed and Sealed this

Fourth Day of February, 1997

*Attest:*

Bruce Lehman

BRUCE LEHMAN

*Attesting Officer*

*Commissioner of Patents and Trademarks*